US005471978A

United States Patent [19]

Yoshida et al.

[11] Patent Number: 5,471,978

[45] Date of Patent: Dec. 5, 1995

[54] CANISTER FOR SEMI-CLOSED BREATHING APPARATUS

[75] Inventors: Akihiko Yoshida; Yasushi Yoshida, both of Kounanmachi, Japan

[73] Assignee: Zexel Corporation, Tokyo, Japan

[21] Appl. No.: 153,166

[22] Filed: Nov. 17, 1993

[30] Foreign Application Priority Data

Nov. 30, 1992 [JP] Japan ..... 4-343133

[51] Int. Cl.[6] ..... A62B 7/10; A62B 9/00; A62B 18/02; A62B 23/02

[52] U.S. Cl. ..... 128/205.22; 128/205.28; 128/205.17; 128/205.25

[58] Field of Search ..... 128/205.27, 205.28, 128/204.18, 204.26, 204.28, 205.12, 205.22, 205.25, 201.25, 205.17, 205.13

[56] References Cited

U.S. PATENT DOCUMENTS 2,324,716 7/1943 Nohl ..... 128/201.25

3,575,167 4/1971 Michielsen ..... 128/205.28

3,710,553 1/1973 Parker et al. ..... 128/205.28

4,186,735 2/1980 Henneman et al. ..... 128/201.25

*Primary Examiner*—Kimberly L. Asher

*Attorney, Agent, or Firm*—Sughrue, Mion, Zinn, Macpeak & Seas

[57] ABSTRACT

A canister for use in a semi-closed type of breathing apparatus for removing carbon dioxide from breathing air circulating in a breathing circuit. The filling portion of the canister is designed in rectangular shape, and thus it can be smoothly assembled with the air tank, the breathing bag, the float adjusting device, etc. In addition, the inlet port and the outlet port are diagonally disposed to each other, so that a uniform flow of the breathing air can be performed in the main body.

6 Claims, 3 Drawing Sheets

CANISTER FOR SEMI-CLOSED BREATHING APPARATUS

BACKGROUND OF THE INVENTION

1. Field of the Invention

This invention relates to a canister for use in a breathing apparatus which is used in water or on land, and particularly to a canister for a semi-closed type of breathing apparatus in which carbon dioxide is removed from breathing air circulating in a breathing circuit and breathing air is supplied from an air tank into the breathing circuit.

2. Description of Related Art

In general, a semi-closed type of breathing apparatus is equipped with a breathing bag, a valve unit, a canister (carbon dioxide absorber) for absorbing carbon dioxide and an air tank. In the semi-closed type of breathing apparatus thus constructed, carbon dioxide is removed from breathing air (gas) circulating in the breathing circuit in the canister, and the breathing air is supplied from the air tank into the breathing circuit while surplus breathing air is discharged from the breathing bag.

This type of conventional breathing apparatus is disclosed in Japanese Laid-open Patent Application No. 50-108797 and Japanese Laid-open Utility Model Registration Application No. 54-3000. The canister of the breathing apparatus as disclosed in these applications is designed in a cylindrical shape. The upper bottom of the canister is equipped with a connection port which is connected to an exhaling duct, and the lower bottom thereof is equipped with a connection port which is connected to an inhaling duct. In this conventional canister, the breathing air flows from the upper bottom to the lower bottom in the canister.

However, in the conventional semi-closed type of breathing apparatus having a canister as described above, when the canister is used while integrally combined with an air tank, a breathing bag and a float adjusting device (buoyancy vest), there occurs a problem that the assembly between the canister and the other elements such as the air tank, the breathing bag, etc. cannot be smoothly performed because of the cylindrical shape of the canister.

On the other hand, when the canister is designed in a square or rectangular shape, the breathing air flow is reduced at the corners, and thus there occurs a problem that a uniform flow of the breathing air cannot be obtained.

SUMMARY OF THE INVENTION

An object of this invention is to provide a canister for a semi-closed type of breathing apparatus, which is smoothly assembled with elements such as an air tank, a breathing bag, etc., and in which breathing air uniformly flows.

In order to attain the above object, the canister for use in a semi-closed type of breathing apparatus according to this invention in which carbon dioxide is removed from breathing air circulating in a breathing circuit, includes a main body which is designed in a rectangular shape and filled with carbon dioxide remover, the main body having first and second sides which are opened and confronted to each other, and breathing air flowing from the first side to the second side, an air-exhaling passageway which is provided along the first side of the main body and supplied with exhaled air, the air-exhaling passageway having an inlet port connected to an exhaling duct at one end portion thereof, and an air-inhaling passageway which is provided along the second side of the main body and serves to guide therethrough the breathing air which has been passed through the carbon dioxide remover, and the air-inhaling passageway having an outlet port connected to an inhaling duct at one end portion thereof, wherein the inlet port and the outlet port are diagonally disposed to each other.

According to the canister of the semi-closed type of breathing apparatus of this invention, the filling portion of the canister is so designed in flat rectangular or orthogonal shape, so that the air tank can be stably disposed on the canister or the canister can be stably disposed between the breathing bag and the air tank. Accordingly, the canister and the elements such as the air tank, the breathing bag, the float adjusting device, etc. can be smoothly and excellently assembled.

Further, the canister is equipped with the connection port for the inhaling duct and the connection port for the breathing bag, which are diagonally disposed to each other. The breathing air which is supplied from the breathing bag and flows in a diagonal direction through the filling portion (carbon dioxide absorber) of the canister suffers the maximum flow resistance because the flow distance of the breathing air in the filling portion is maximum in the diagonal direction of the filling portion. Therefore, as a whole, the breathing air is liable to flow in a horizontal direction through the filling portion because the flow distance of the breathing air in the filling portion is minimum in the horizontal direction and thus the flow resistance is minimum. Accordingly, the breathing air is allowed to uniformly flow in the filling portion.

DETAILED DESCRIPTION OF THE PREFERRED EMBODIMENT

A preferred embodiment according to this invention will be described hereunder with reference to FIGS. 1 to 4.

Figure 1:
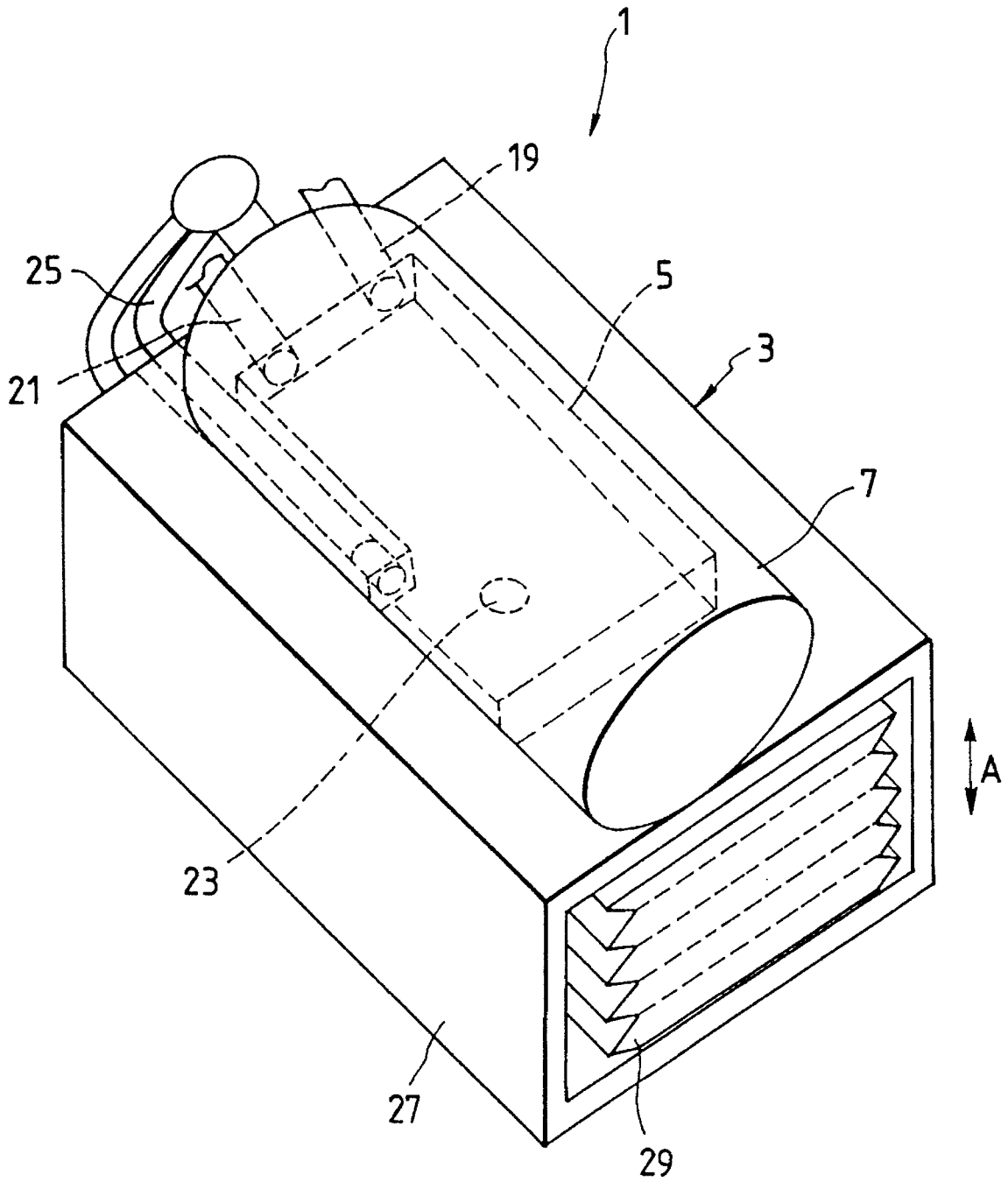
FIG. 1 is a perspective view of a semi-closed type of breathing apparatus of an embodiment according to this invention.
Figure 2:
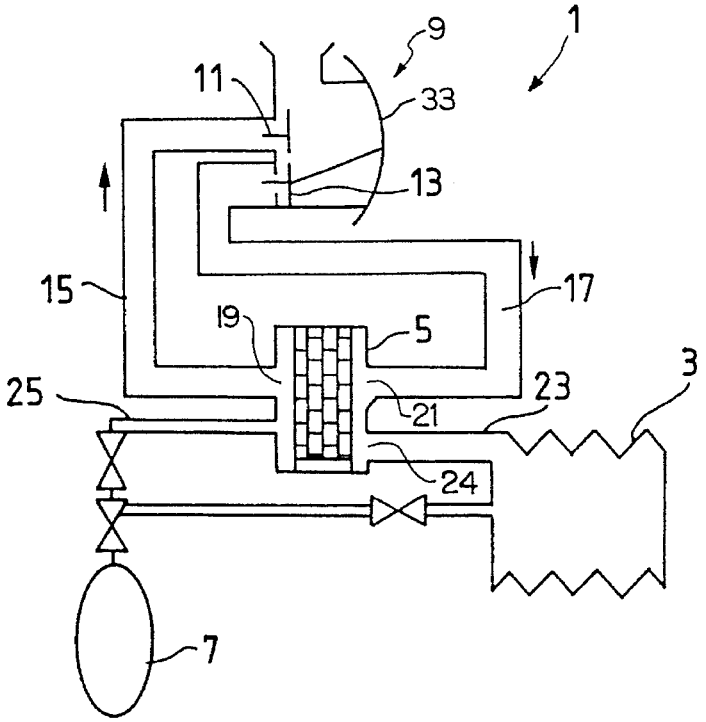
FIG. 2 is a circuit diagram for breathing air in the semi-closed type of breathing apparatus as shown in FIG. 1.

As shown in FIGS. 1 and 2, a semi-closed type of breathing apparatus according to this embodiment comprises a breathing bag 3, a canister 5, an air tank 7 and a mouthpiece 9. For an exhaling operation, breathing air exhaled from the mouthpiece 9 is supplied to the breathing bag 3. On the other hand, for an inhaling operation, breathing air in a breathing circuit is supplied from the breathing bag 3 through the canister 5 to the mouthpiece 9. In addition, a constant amount of air is supplied from the air tank 7 into the breathing circuit.

The mouthpiece 9 is provided with an inhaling valve 11 and an exhaling valve 13, and each of the valves 11 and 13 comprises a check valve. In the inhaling operation only the inhaling valve 11 is opened, and in the exhaling operation only the exhaling valve 13 is opened. The exhaling Valve is switched on and off through deformation of a diaphragm 33.

The inhaling valve 11 is connected to one end of an inhaling duct 15, and the exhaling valve 13 is connected to one end of an exhaling duct 17. The other ends of the inhaling duct 15 and the exhaling duct 17 are connected to the canister 5.

Figure 4:
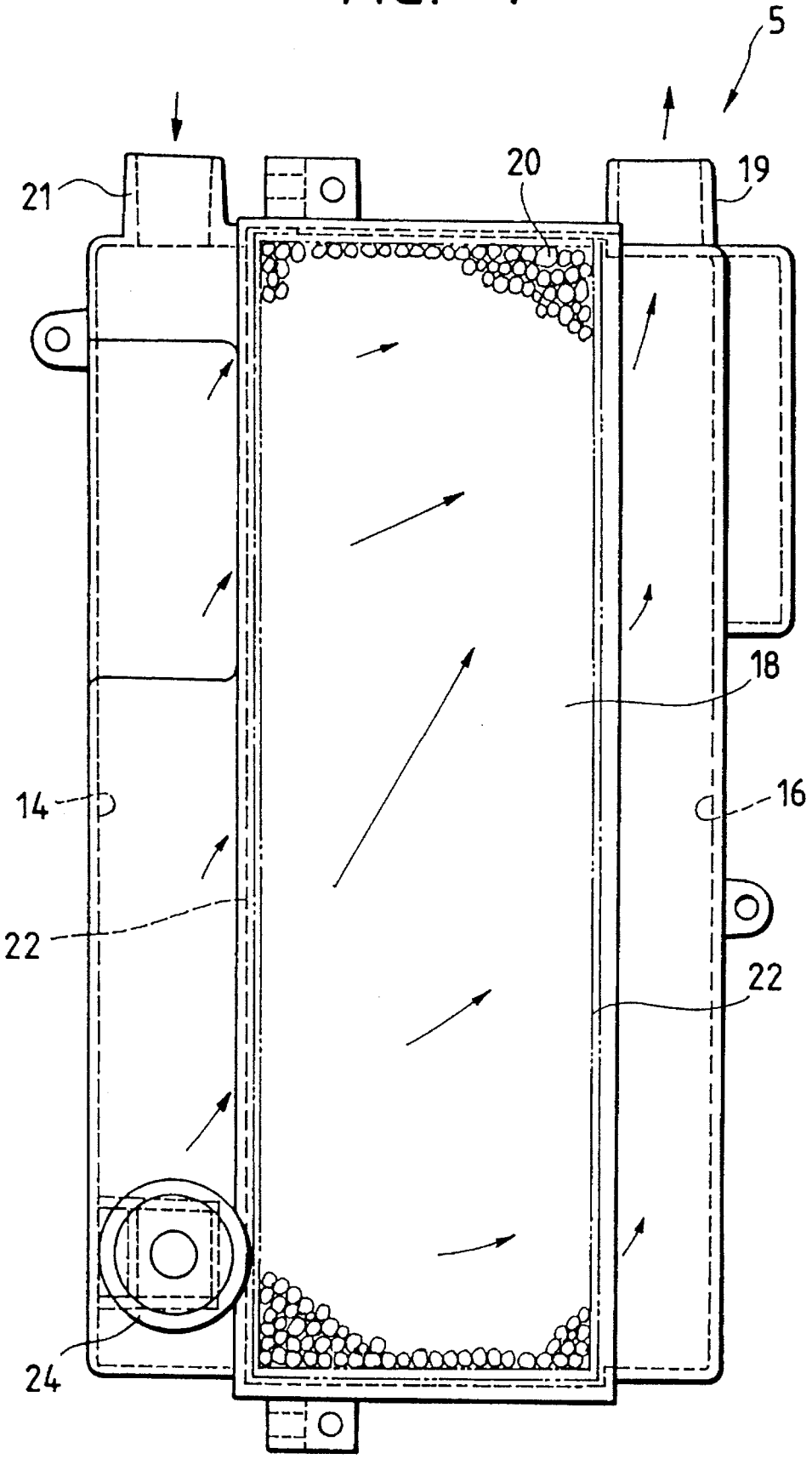
FIG. 4 is a plan view of a canister.

As shown in FIG. 4, the main body 18 of the canister 5 is designed in a flat rectangular or orthogonal shape. An air-exhaling passageway 14 (passageway at one side) is provided at one side of the flat rectangular main body 18, and an air-inhaling passageway 16 (passageway at the other side) is provided at the other side of the flat rectangular main body 18 so as to confront the air-exhaling passageway 14. Carbon dioxide absorber/remover 20 is filled in the main body 18 between the air-exhaling passageway 14 and the air-inhaling passageway 16, whereby carbon dioxide contained in the breathing air passing through the main body 18 is removed by the absorber 20. As described above, the main body 18 is rectangular in section, and it is separated or partitioned from the air-exhaling and air-inhaling passageways 14, by an air-permeable sponge 22, as shown in FIG. 4.

The canister 5 is provided with an exhaling port 21 at the upper portion of the exhaling passageway 14 formed at the one side thereof, and with a connection port 24 for the breathing bag at the lower portion of the exhaling passageway 14. The canister 5 is also provided with an outlet port 19 of the inhaling duct at the upper portion of the air-inhaling passageway 16 formed at the other side thereof. The exhaling port 21 and the outlet port 19 are formed so as to project from the canister 5 in parallel with each other, and the outlet port 19 for the inhaling duct is disposed at a diagonal position to the connection port (inlet port) 24 for the breathing bag.

The inlet port 24 is connected through a duct 23 to the breathing bag 3, and the air in the canister 5 flows into or returns from the breathing bag 3. On the other hand, the canister 5 is connected through a duct 25 to the air tank 7, and a constant amount of air is supplied from the air tank 7 into the breathing circuit at all times.

The breathing bag 3 comprises a case 27 and a bag body 29. As shown in FIG. 1, the case 27 is designed to be a hollow rectangular parallelepiped in shape, and the bag body 29 itself is accommodated in the hollow portion of the case 27. The bag body 29 is shaped like a bellows and formed of elastic material such as rubber or the like. Accordingly, when the breathing air flows into and out of the breathing bag, the bag expands and contracts in the directions indicated by the arrow A of FIG. 1.

The operation of the breathing apparatus in this embodiment will be described.

Figure 3:
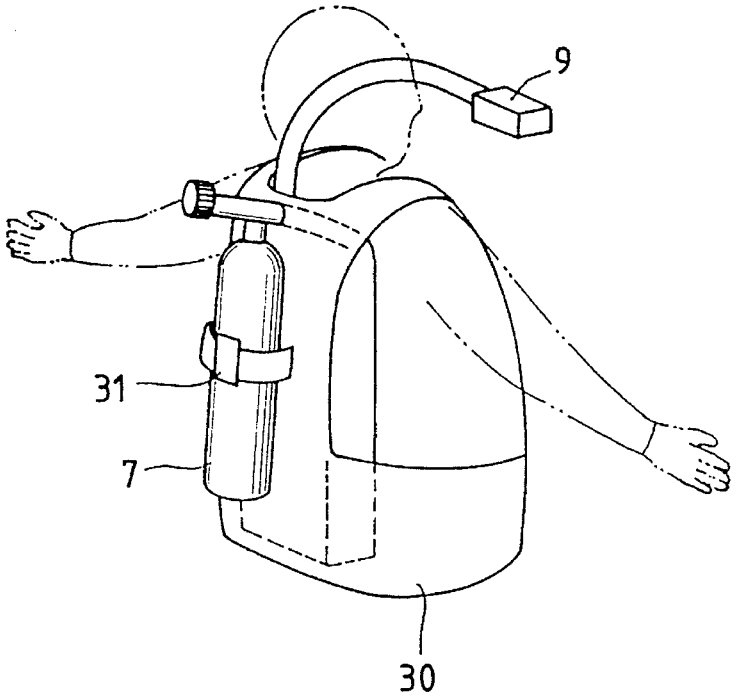
FIG. 3 is a perspective view showing a state where a user carries the semi-closed type of breathing apparatus as shown in FIG. 1 on his back.

In a state where a user carries the semi-closed type of breathing apparatus on his back, as shown in FIG. 3, the canister 5 and the breathing bag 3 are disposed inside of the float adjusting apparatus 30 (on the user's side) and the air tank 7 is disposed on the outside of the float adjusting apparatus 30. The air tank 7 is fixed to the canister 5 and the breathing bag by a belt 31. Thus constructed, the canister is designed in a flat rectangular shape like the breathing bag 3, so that the canister is easily and smoothly fitted to the user and it can be easily assembled with the breathing bag and the air tank 7.

When the user takes the mouthpiece 9 in his mouth and exhales air, the inhaling valve 11 of the mouthpiece 9 is closed, and the exhaling valve 13 is opened, so that the breathing air flows through the exhaling duct 17, the canister 5 and the duct 23 into the bag body 29 of the breathing bag 3. In this operation, the bag body 29 is expanded as indicated by the arrow A in the case 27.

Subsequently, when the user inhales, the inhaling valve 11 of the mouthpiece 9 is opened and the exhaling valve 13 is closed. Therefore, the breathing bag 3 is contracted and the breathing air in the breathing bag 3 flows through the duct 23 to the inlet port 24 and into the canister 5.

The breathing air which flows from the bag body 3 to the canister 5 is passed through the air-exhaling passageway 14 and flows into the filling portion 18 which is filled with the carbon dioxide absorber. Thereafter, the breathing air from which carbon dioxide is removed in the filling portion 18 is passed through the air-inhaling passageway 16 to the outlet port 19 which is the connection port for the inhaling duct 15.

In the filling portion 18 filled with the carbon dioxide absorber, as shown in FIG. 4, the flow of the breathing air in the linear direction connecting the outlet port 19 to the inlet port 24, that is, in the diagonal direction of the canister 5, suffers high resistance because the flow distance of the breathing air in this direction is long, and thus the breathing air hardly flows in this direction. On the other hand, the flow of the breathing air in the horizontal direction of the canister suffers small resistance, and thus more breathing air flows in this horizontal direction. Accordingly, the breathing air in the main body flows not only in the diagonal direction, but in the horizontal direction, and in other words, the breathing air flows fully in the whole portion of the rectangular main body. Therefore, the breathing air is allowed to uniformly and fully flow through the carbon dioxide absorber filled in the canister 5 as a whole.

In the above embodiment, the main body is preferably so designed that the distance between the air-exhaling passageway and the air-inhaling passageway is preferably longer than the thickness thereof. Further, the main body is preferably so designed that when the user carries the canister on his back, the inlet port is located at the user's hip and the outlet port is located at the user's head.

This invention is not limited to the above embodiment, and various modifications may be made to the above embodiment without departing from the subject matter of this invention. For example, in the above embodiment, the outlet port 19 for connecting the inhaling duct is projected at the same side as the exhaling port 21 for connecting the exhaling duct, however, the projecting position of the outlet port 19 is not limited to the above position. That is, the outlet port 19 may project in a lateral direction of the air-inhaling passageway 16 or other directions insofar as it is located at such a position as to diagonally confront to the inlet port 24.

What is claimed is:

1. A semi-closed breathing apparatus, comprising:

a) a canister removing carbon dioxide from breathing air circulating in a breathing circuit, said canister comprising:

1) an elongate main body (18) designed in a flat orthogonal shape and filled with carbon dioxide remover material (20), first and second sides of the main body being open and confronting each other such that breathing air flows across a width of the main body from said first side to said second side;

2) an air-exhaling passageway (14) extending along said first side of said main body and supplied with exhaled air, said air-exhaling passageway having an inlet port (24) at one end thereof connected to an exhaling duct (17); and 3) an air-inhaling passageway (16) extending along said second side of said main body and serving to guide therethrough breathing air which has passed through said carbon dioxide remover material, said air-inhaling passageway having an outlet port (19) at one end thereof connected to an inhaling duct (15), wherein said inlet port and said outlet port are disposed at diagonally opposite corners of said main body;

b) a breathing bag (3) having an inlet/outlet duct (23) coupled to both said inlet port (24), and to said exhaling duct (17) via said air-exhaling passageway; and c) means for achieving a uniform and full flow of exhaled air through the carbon dioxide remover material in said elongate main body in both horizontal and diagonal directions, said achieving means comprising the first and second sides of the main body being longest sides, the air-exhaling passageway extending along the full length of the first side and being in communication with said carbon dioxide remover material in said elongate main body all along said air-exhaling passageway, and the air-inhaling passageway extending along the full length of the second side and being in communication with said carbon dioxide remover material in said elongate main body all along said air-inhaling passageway.

2. The apparatus as claimed in claim 1, wherein said main body is designed in such a shape that the distance between said air-exhaling passageway and said air-inhaling passageway is longer than the thickness thereof.

3. The apparatus as claimed in claim 1, wherein said main body is provided with a sponge at each of said first and second open sides.

4. The apparatus as claimed in claim 1, further comprising an air tank (7) having a supply hose connected to said exhaling duct, wherein a constant amount of air is supplied to said canister main body at all times.

5. The apparatus as claimed in claim 1, wherein when a user carries said canister on his back, the inlet port is located proximate a hip of the user and the outlet port is located proximate a head of the user.

6. The apparatus as claimed in claim 1, further comprising an air tank (7), wherein said canister is disposed between said breathing bag and said air tank.

* * * * *